US007444104B2

(12) United States Patent
Wayman et al.

(10) Patent No.: US 7,444,104 B2
(45) Date of Patent: Oct. 28, 2008

(54) VARIABLE ENERGY DEVELOPMENT STATION USING A MAGNET TO RESTRICT DEVELOPER MATERIAL FLOW IN THE DEVELOPMENT STATION

(75) Inventors: William H. Wayman, Ontario, NY (US); Paul John McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 57 days.

(21) Appl. No.: 11/827,631

(22) Filed: Jul. 12, 2007

(65) Prior Publication Data

US 2007/0258734 A1 Nov. 8, 2007

Related U.S. Application Data

(62) Division of application No. 11/378,810, filed on Mar. 17, 2006, now Pat. No. 7,263,316.

(51) Int. Cl.
*G03G 15/08* (2006.01)

(52) U.S. Cl. ..... 399/256; 399/267

(58) Field of Classification Search ..... 399/256, 399/267

See application file for complete search history.

(56) References Cited

U.S. PATENT DOCUMENTS

| | | | | | |
|---|---|---|---|---|---|
| 3,948,217 | A | * | 4/1976 | Forward | 399/110 |
| 4,816,870 | A | * | 3/1989 | Nagayama | 399/267 |
| 5,563,689 | A | * | 10/1996 | Tompkins et al. | 399/272 |
| 5,659,859 | A | | 8/1997 | Kikuta et al. | |
| 6,785,481 | B2 | | 8/2004 | Bray et al. | |

* cited by examiner

*Primary Examiner*—David M. Gray
*Assistant Examiner*—Bryan Ready
(74) *Attorney, Agent, or Firm*—Maginot, Moore & Beck

(57) ABSTRACT

An improved development station extends the useful life of toner in the housing and increases the number of images developed by the developer supply. The improved development station includes a development station housing having a developer sump, a toner supply for providing toner material to the developer sump, a mixing auger for uniformly blending and charging toner particles provided by the toner supply into developer material, a magnetic roller for receiving the developer material and bringing the developer material into contact with a photoreceptive member, and a magnet for generating a varying magnetic field to restrict flow of the developer material in the development station housing.

18 Claims, 4 Drawing Sheets

VARIABLE ENERGY DEVELOPMENT STATION USING A MAGNET TO RESTRICT DEVELOPER MATERIAL FLOW IN THE DEVELOPMENT STATION

CLAIM OF PRIORITY

This application is a divisional application of U.S. patent application Ser. No. 11/378,810, which is entitled "Variable Energy Development Station," that was filed on Mar. 17, 2006 now U.S. Pat. No. 7,263,316.

TECHNICAL FIELD

This disclosure relates generally to electro-photographic printing machines, and, more particularly to the development stations used in such machines.

BACKGROUND

In a typical electro-photographic printing process, a photoreceptive member is sensitized by charging its surface to a substantially uniform potential. The charged portion of the photoreceptive member is exposed to a light image of an original image being reproduced. Exposure of the charged photoreceptive member selectively dissipates the charge in the irradiated areas to record an electrostatic latent image on the photoreceptive member. After the electrostatic latent image is recorded on the photoreceptive member, developer material is brought into contact with the image area of the photoreceptive member to develop the latent image.

Latent image development occurs as toner particles are removed from the developer material and adhere to the latent image. Developer material is generally comprised of toner particles and carrier granules. The toner particles adhere to the carrier granules by charge that is generated triboelectrically. As the developer comes into contact with the latent image, the toner particles are attracted by the charge of the latent image and migrate from the carrier granules to the latent image. This migration of toner particles to the latent image forms a toner powder image on the photoreceptive member. The toner powder image is then transferred from the photoreceptive member to a copy sheet. The toner particles are heated to permanently affix the powder image to the copy sheet.

In most two component development stations, the developer material is mechanically stressed as it is mixed by one or more augers and travels on the magnetic surface roller. These mechanical stresses help to triboelectrically charge the developer so the toner particles adhere to the carrier granules. The toner is not always removed from the developer at a constant rate, however, because some images require more toner for development than other images. Thus, toner may be charged for used and provided to the magnetic roller, but remain on the roller as the latent image passes. That is, the portion of the latent image closest to the developer on the magnetic roller does not have sufficient charge to attract the toner. Consequently, the developer is returned to the developer sump for later use.

The developer returned to the sump is again subjected to mixing. After some time, the mechanical stress on the toner particles causes their surface additives to impact into the toner particles and the tone can also impact onto the carrier granules. Surface additives are included to control charge and to lower toner adhesion to the photoreceptor and other surfaces for improvement of transfer efficiency and image uniformity. Continuing this impact eventually degrades the usefulness of the toner surface additives and the ability of the toner particles to hold a charge sufficient for good image quality. Electrophotographic machines include components and processes for purging these toner particles from the system. The removed toner, however, is toner that was not used to generate images. This toner must be replaced by fresh toner, some of which is eventually unused and removed from the machine. Thus, depending on the content of the images to be developed by the machine, the developer provided in a developer supply may not all be efficiently used. Moreover, the number of quality images produced by a developer supply is reduced by the loss of toner that was not used to generate images.

One way of addressing this issue is to drive the mixing augers and magnetic rollers at a speed that does not overly stress the developer material. As noted above, however, the demand for toner in an image varies from image to image. Consequently, the development station needs to charge adequately a sufficient amount of toner to meet the varying requirements for developing the latent images on the photoreceptive member. Currently, the waste of some toner is deemed an acceptable tradeoff for providing sufficient toner for developing images having a variable amount of content.

SUMMARY

An improved development station extends the useful life of toner in the housing and increases the number of images developed by the developer supply. The improved development station includes a development station housing having a developer sump, a toner supply for providing toner material to the developer sump, a mixing auger for uniformly blending and charging toner particles provided by the toner supply into developer material, a magnetic roller for receiving the developer material and bringing the developer material into contact with a photoreceptive member, and a magnet for generating a varying magnetic field to restrict flow of the developer material in the development station housing.

The development station may be used in an electro-photographic machine that includes a photoreceptive member, a corona generating device for initially charging an image area of the photoreceptive member, a latent image generator for selectively discharging the image area of the photoreceptive member to generate a latent image, a development station for developing the latent image with toner from developer material supplied by the development station, a media supply for providing media sheets, a transfer station for transferring the developed latent image from the photoreceptive member to a media sheet received from the media supply, a fusing station for permanently affixing the transferred latent image to the media sheet. To extend the useful life of the toner, the development station of the printer further includes a toner supply for providing toner particles to a developer sump, a mixing auger for uniformly blending and charging toner particles into the developer material as the toner particles are provided by the toner supply, a magnetic roller for receiving the developer material and bringing the developer material into contact with a photoreceptive member, and a magnet for generating a varying magnetic field in a volume adjacent the mixing auger to restrict flow of developer material being moved by the mixing auger.

BRIEF DESCRIPTION OF THE DRAWINGS

Aspects of the development station disclosed herein are apparent from the following description and drawings.

DETAILED DESCRIPTION

Figure 1:
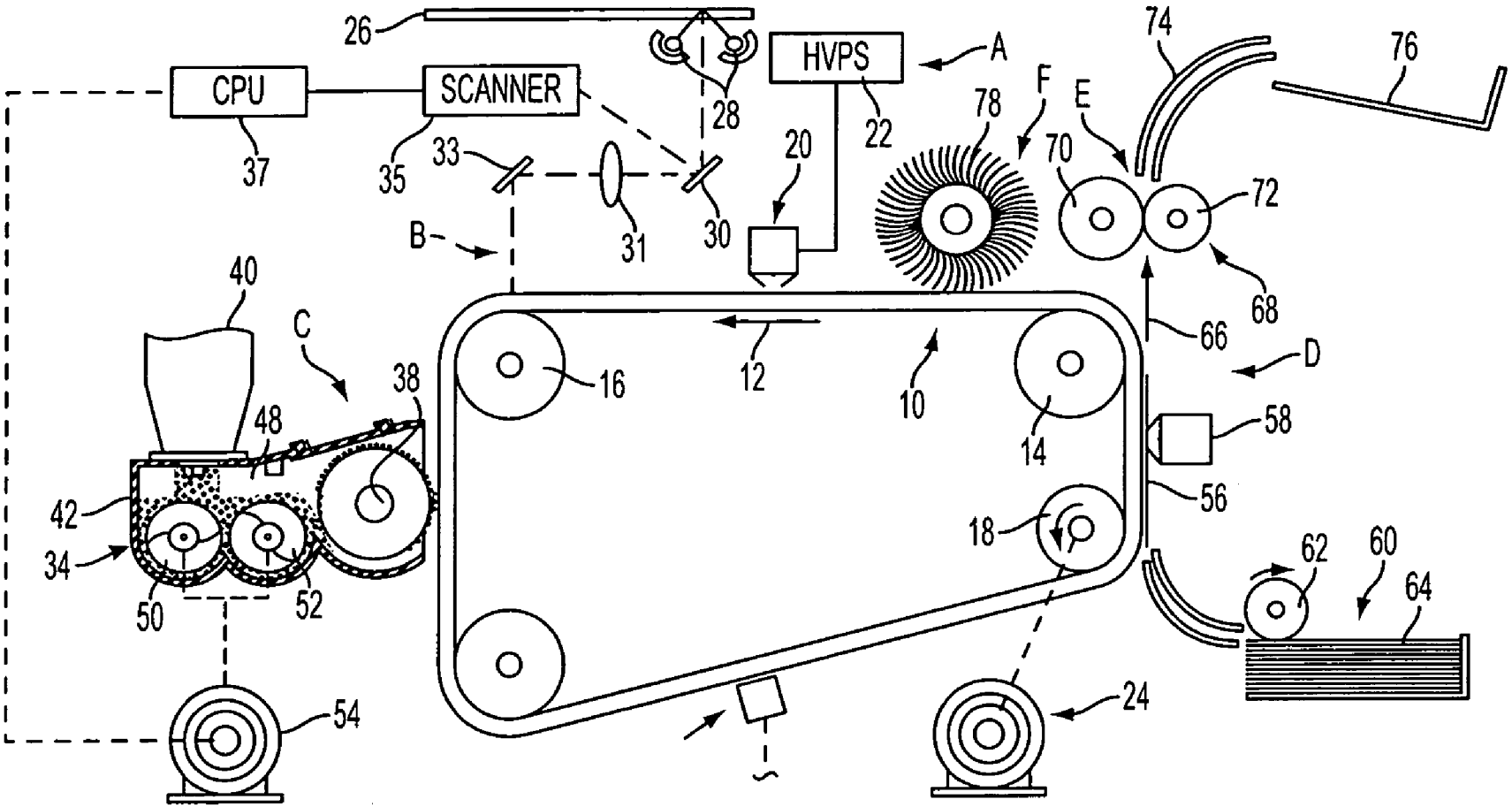
FIG. 1 is a schematic view depicting an illustrative electrophotographic printing machine incorporating the development station enclosed herein.

For a general understanding of the features of the development station disclosed herein, reference is made to the drawings. In the drawings, like reference numerals have been used throughout to identify identical elements. FIG. 1 schematically depicts an electro-photographic printing machine incorporating the features of the development station. From the following discussion, one is able to discern that the various embodiments of the development station disclosed herein may be employed in a wide variety of printing machines and are not specifically limited in their application to the particular embodiments depicted herein.

Referring to FIG. 1 of the drawings, the electro-photographic printing machine employs a photoreceptive belt 10. Belt 10 moves in the direction of arrow 12 to advance successive portions of the photoreceptive surface sequentially through the various processing stations disposed about its path of movement. Belt 10 is entrained about stripping roller 14, tensioning roller 16, and drive roller 18. Stripping roller 14 is mounted so it rotates with belt 10. Tensioning roller 16 is resiliently urged against belt 10 to maintain belt 10 under the desired tension. Drive roller 18 is coupled to a motor 24 by suitable means, such as a belt drive, to rotate the roller.

As drive roller 18 rotates, it advances belt 10 in the direction of arrow 12. Initially, a portion of the photoreceptive surface passes through charging station A. At charging station A, a corona generating device, indicated generally by the reference numeral 20, charges the photoreceptive belt 10 to a relatively high, substantially uniform potential. Corona generating device 20 includes a generally U-shaped shield and a charging electrode. A high voltage power supply 22 is coupled to corona generating device 20. A change in the output of power supply 22 causes corona generating device 20 to vary the charge applied to the photoreceptive belt 10.

The charged portion of the photoreceptive surface is advanced through imaging station B, which records an electrostatic latent image on the photoreceptive belt with a latent image generator. In FIG. 1, the latent image generator includes light sources 28, mirrors 30, 33, and lens 31. The light sources 28 illuminate a document 26 line by line. The light reflected by the document is reflected by mirror 30 through lens 31 and then reflected by mirror 33 onto the photoreceptive belt 10 as it moves past the station. In other imaging systems, the latent image generator is a raster output scanner (ROS). An electronic version of a document may be used to drive a ROS for selectively discharging the photoreceptive belt to form a corresponding latent image on the belt.

The electrostatic latent image is then developed with toner particles at development station C. At development station C, a magnetic brush development system, indicated generally by the reference numeral 34, advances a developer material into contact with the electrostatic latent image on photoreceptive belt 10. The magnetic brush development system may include a magnetic brush developer roll 38. The magnetic roll advances the developer material into contact with the latent image. The developer roll forms a brush comprising carrier granules and toner particles. The latent image attracts the toner particles from the carrier granules forming a toner powder image on the latent image.

As toner particles are depleted from the developer material, a toner particle dispenser, indicated generally by the reference numeral 40, furnishes additional toner particles to housing 42 for subsequent use by developer roll 38. Toner dispenser 40 stores a supply of toner particles that are dispensed into sump 48 for mixing by augers 50 and 52. Augers 50 and 52 are helical screws that rotate within the sump 48. Motor 54 is coupled to each of the augers 50 and 52 to rotate the augers and advance the toner particles through a racetrack formed between the two augers. In one embodiment, the augers are independently coupled to the motor 54 so they may rotated at different speeds. In another embodiment, motor 54 is coupled to the augers to drive them synchronously. Actuation of motor 54 is controlled by CPU 37, which is in a control system for the electro-photographic machine shown in FIG. 1.

After development, the toner powder image is advanced to transfer station D. At transfer station D, a copy sheet 56 is moved into contact with the toner powder image. The copy sheet is advanced to transfer station D by a sheet feeding apparatus 60. Preferably, sheet feeding apparatus 60 includes a feed roll 62 contacting the uppermost sheet of a stack 64 of sheets. Feed rolls 62 rotate so as to advance the uppermost sheet from stack 64 into chute 66. Chute 66 guides the advancing sheet from stack 64 into contact with the photoreceptive belt in a timed sequence so that the toner powder image developed thereon contacts the advancing sheet at transfer station D. At transfer station D, a corona generating device 58 sprays ions onto the backside of sheet 56. This attracts the toner powder image from the photoreceptive belt 10 to copy sheet 56. After transfer, the copy sheet is separated from belt 10 and a conveyor advances the copy sheet, in the direction of arrow 66, to fusing station E.

Fusing station E includes a fuser assembly, indicated generally by the reference numeral 68 which permanently affixes the transferred toner powder image to the copy sheet. Preferably, fuser assembly 68 includes a heated fuser roller 70 and a pressure roller 72 with the powder image on the copy sheet contacting fuser roller 70. In this manner, the toner powder image is permanently affixed to sheet 56. After fusing, chute 74 guides the advancing sheet 56 to catch tray 76 for subsequent removal from the printing machine by the operator. After the copy sheet is separated from photoreceptive belt 10, the residual toner particles and the toner particles adhering to the test patch are cleaned from photoreceptive belt 10. These particles are removed from photoreceptive belt 10 at cleaning station F.

Cleaning station F includes a rotatably mounted fibrous brush 78 in contact with photoreceptive belt 10. The particles are cleaned from photoreceptive belt 10 by the rotation of brush 78. Subsequent to cleaning, a discharge lamp (not shown) floods photoreceptive belt 10 with light to dissipate any residual electrostatic charge remaining thereon prior to the charging thereof for the next successive imaging cycle. The foregoing description is considered sufficient for purposes of illustrating the general operation of an electro-photographic printing machine in which the development station disclosed herein may be used.

Figure 2:
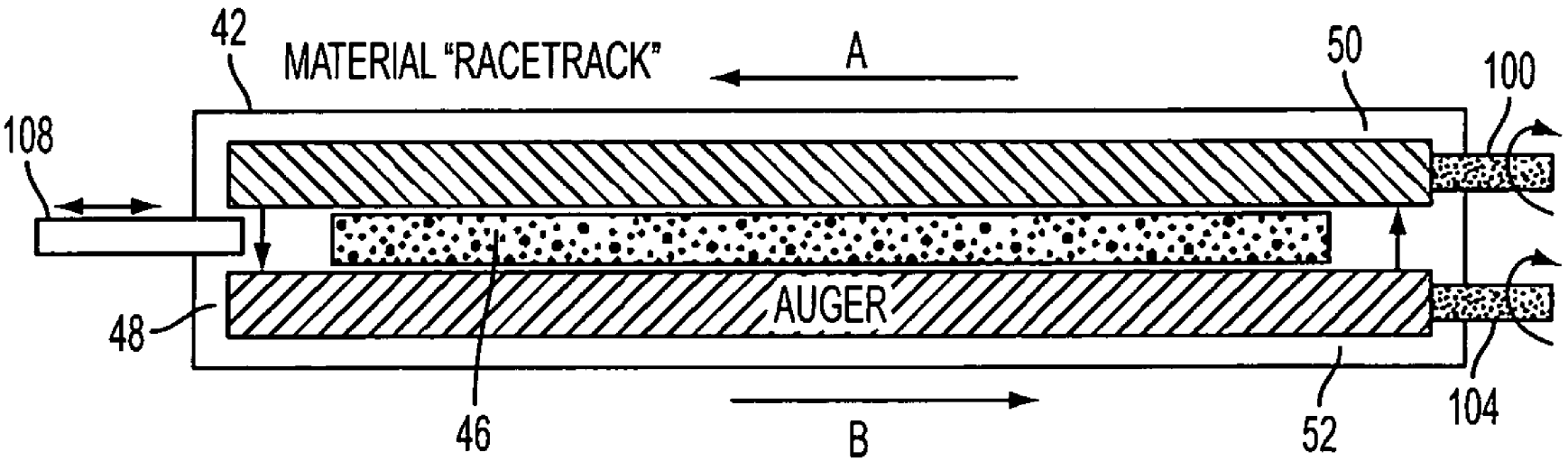
FIG. 2 is a top schematic view of one embodiment of a development station that may be used in the printing machine of FIG. 1.

Referring now to FIG. 2, one embodiment of a development station is shown that variably inputs energy into the developer material in accordance with the demand for toner at the development station C. The development station housing 42 has two rotating augers 50 and 52 mounted in the sump 48. Drive shafts 100 and 104 extend from the augers 50 and 52, respectively, for coupling the augers to the motor 54. In the embodiment shown in FIG. 2, the augers 50 and 52 may be driven at a constant speed by the motor 54. The developer material flows along auger 50 in the direction indicated by arrow A while the developer material flows along auger 52 in the direction indicated by arrow B. The path described by these two flows is sometimes referred to as a racetrack.

A variable developer material restrictor is incorporated in the development station of FIG. 2 to restrict variably the flow of developer material through the racetrack to vary the mechanical stress for the developer and, accordingly, the toner to carrier turboelectric charging. The rate of restriction variation corresponds to the demand for toner. In FIG. 2, the variable developer material restriction is a displaceable member 108 extends through the housing 42 into the sump 48. The member 108 may be moved bi-directionally as shown in the figure. In response to detection of an image requiring relatively high density coverage, the member 108 is moved so it extends in the volume between the augers 50 and 52. Thus, the end portion of the member 108 restricts the flow of developer material in the volume between the two augers. This restriction in the flow raises the mechanical stress or work done to the developer material in the racetrack. The resulting increase in work on the material means the development station is putting more energy into the developer material and increasing the toner charging for the detected demand. In response to signal indicating a lower density image is to be processed, the vane moves out of the volume between the augers. Removing the restriction enables the material to flow with less work around the race track with less energy being imparted to the toner. As a consequence, less mechanical stress is supplied to the developer material and the material is conserved. In other embodiments using a displaceable member, the member may be spring biased so removal of the force that pushes the member into the volume between the two augers enables the member to withdraw from the volume. In other embodiments using a displaceable member, the member position can be varied over a continuous range of positions so that a variable amount of mechanical stress is supplied to the developer material.

The density of an image to be processed is detected using the scanner 35 shown in FIG. 1. The scanner detects the dark pixel count in each line of an image to be processed. The pixel count is provided to the CPU 37. From the pixel count for an image, the CPU is programmed to determine whether the image is a relatively high density image or not. The CPU then asserts a signal to activate an actuator for moving the displaceable member in response to detection of a relatively high density image. Additional description of the detection of toner density and it use to control development is set forth in U.S. Pat. No. 6,785,481, which is commonly owned by the assignee of this application, and its entire disclosure is hereby expressly incorporated herein by reference. Alternatively, the variable energy actuator can be controlled by the rate of toner dispensed into the developer sump. For high rates of dispensing, the energy actuator is set to the high energy level and with a low toner dispensing rate, the energy is set to a low level. Likewise, movement of a linear energy actuator may be correlated to the rate of toner being dispensed into the developer sump.

Figure 3:
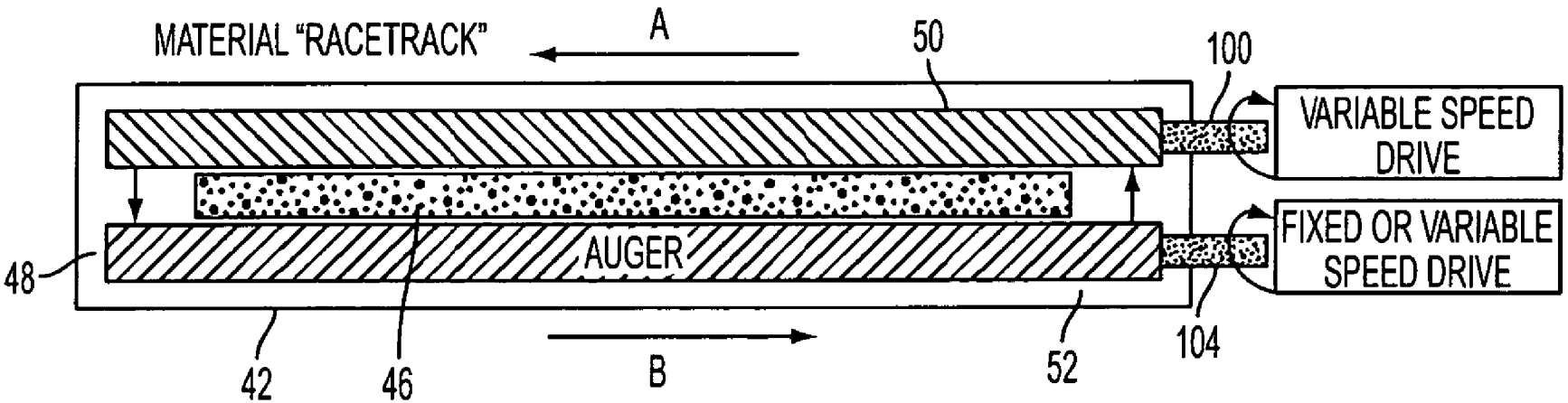
FIG. 3 is a top schematic view of another embodiment of a development station that may be used in the printing machine of FIG. 1.

Another embodiment of a variable developer material restrictor is shown in FIG. 3. In this view, the augers 50 and 52 are located in the developer housing 42 with drive shafts 100 and 104, respectively, extending from the housing. No displaceable member is provided, however, to vary the work done on the toner in the developer material. Instead, the drive shafts are coupled to the motor 54 through independent gear trains. Clutches for at least one of the gear trains is coupled to the CPU 37. In response to the detection of a relatively high density image, the CPU 37 activates the clutch to change the driving force for one of the augers. The motor 54 now drives the two augers at different speeds. Because the augers have the same screw pitch, they push through the same amount of developer material in the same unit of time as long as they are driven at the same speed. When one auger is driven at a different speed than the other auger, the rate of material pushed by the auger changes. This differential backs up the flow of material in the racetrack and causes the torque operating on the developer to increase. The torque increase imparts more energy to the toner in the developer material and again increases the amount of toner charging available for pick up by the magnetic rollers. The CPU 37 can activate the clutch to return the augers to the same speed to reduce the torque and generate less toner charging for the lower toner demand in images requiring less toner coverage. Alternatively, the drive shafts 100 and 104 may be coupled to separate drives, one of which may be variable and the other of which may be fixed or variable. The CPU 37 controls the speed of these drives in a manner similar to that described above with respect to the gear trains.

Figure 4:
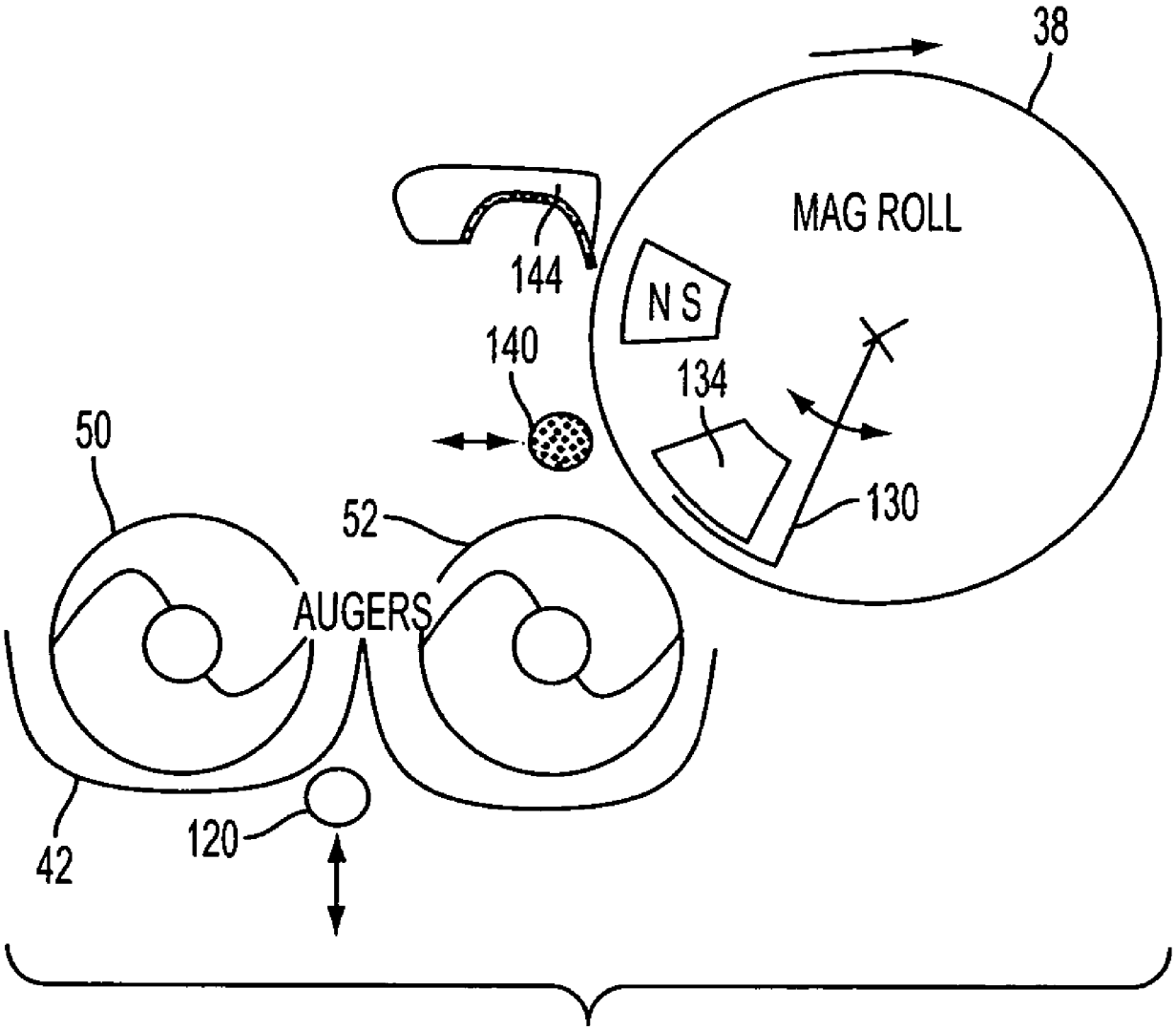
FIG. 4 is a side schematic view showing three other embodiments of a development station that may be used in the printing machine of FIG. 1.

FIG. 4 depicts three other embodiments of the variable developer material restrictor. Although all three embodiments are depicted as being used in the development station together, each one may be used without the other embodiments or other combinations of the embodiments may be used to implement a variable developer material restrictor. One of the embodiments includes a magnet 120 located outside the housing 42 in the vicinity of the interface between the two augers 50 and 52. The magnet 120 is used to generate a variable magnetic field in the volume between the two augers. In one embodiment that uses a varying magnetic field, the magnet 120 may be moved bi-directionally, as shown in the figure, with respect to its distance from the housing 42. This spatial variation alters the strength of the magnetic field in the volume between the two augers. In response to a relatively high density image being detected, the magnet is brought into proximity with the housing 42 so the magnetic field attracts the toner and restricts the flow of developer material through the volume. The movement of the magnet may be performed by an actuator coupled to the CPU 37. Alternatively, an electromagnet may be used. The electromagnet is coupled to the CPU 37, which varies the current to vary the magnetic field generated by the electromagnet.

In another embodiment of a variable developer material restrictor, a magnetic field shunt 130 may be used. As shown in FIG. 4, a magnetic roller 38 includes an internal magnet 134. The internal magnet helps attract charged toner to the magnetic roller. The magnetic field shunt is moveable from a position that effectively short circuits the magnetic field effect on the developer material exiting the housing 42 in the vicinity of the magnetic roller 38. The shunt may be made from a ferrous material or the like that absorbs the magnetic field lines from the magnet 134. The movement of the shunt may be performed by an actuator that is coupled to the CPU 37. The shunt is in position for low density images and moved away from the magnet for relatively high density images. The shunt may be spring-biased to the position that shunts the magnetic field so the actuator is activated to push the shunt against the spring in response to relatively high density images.

Another embodiment of the variable developer material restrictor is a moveable pre-trimmer 140. The pre-trimmer 140 is a moveable member that is aligned with the longitudinal axis of the magnetic roller and positioned over the auger 52 downstream from the area where the magnetic roller picks up developer material from the auger 52. The pre-trimmer 140 is moved into position near the magnetic roller to remove developer material from the magnetic roller before it reaches the trimmer 144. The trim gap between the trimmer 144 and the magnetic roller is a critical dimension for the effectiveness of latent image development. The mechanical stress occurring at this gap is significant and, consequently, the life of the material trimmed from the magnetic roller is substantially reduced. When lower density images are being processed, the pre-trimmer presents a less mechanically stressful barrier to the developer material on the magnetic roller than the trimmer does. The material removed by the pre-trimmer has a longer life than material that has been removed by the trimmer. This material is returned to the sump for later use and the likelihood of its being productive used to develop an image is higher than material that has undergone trimming. The pre-trimmer is coupled to an actuator that is coupled to the CPU 37 for the control of its movement.

The variable developer material restrictor lengthens the life of the developer material, extends the number of images developed by a supply of developer material, and improves the quality of the images produced. These advantages arise from the variable input of energy to the toner particles in a manner that corresponds to the demand for toner particles. Reducing the energy input to the toner particles when lower density images are being developed and increasing the energy in response to relatively high density images enables the development station to conserve toner. By reducing the energy input to the material for developing low density images, fewer toner particles are impacted into carrier granules and the usefulness of the toner surface additives is extended. For relatively high density images, the energy input to the material is increased to provide adequate mixing or other mechanical stress for charging fresh toner particles.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A development station for an electro-photographic machine comprising:

a development station housing having a developer sump;

a toner supply for providing toner material to the developer sump;

a pair of mixing augers having a volumetric space between the mixing augers in which the mixing augers uniformly blend and charge toner particles provided by the toner supply into developer material;

a magnetic roller for receiving the developer material and bringing the developer material into contact with a photoreceptive member, and a magnet positioned to generate a varying magnetic field in the volumetric space between the pair of mixing augers to vary restriction of the developer material in the volumetric space between the pair of mixing augers in the development station housing.

2. The development station of claim 1, the magnet being movable with respect to the pair of mixing augers to generate the varying magnetic field in the volumetric space between the pair of mixing augers.

3. The development station of claim 2, the moveable magnet being located outside the development station housing.

4. The development station of claim 3 further comprising:

an actuator for moving the magnet bi-directionally with reference to the development station housing to alter magnetic field strength in the volumetric space between the pair of mixing augers.

5. The development station of claim 1, the magnet being coupled to a variable power source, the variable power source being configured to vary current supplied to the magnet to alter the magnetic field generated by the magnet.

6. The development station of claim 1 further comprising:

a second magnet being located within the magnetic roller; and a moveable magnetic shunt located within the magnetic roller, the magnetic shunt in a first position reduces the magnetic field extending from the second magnet and in a second position enables the magnetic field to extend into the developer material exiting from the development station housing to restrict flow of the developer material.

7. The development station of claim 6, the shunt being comprised of ferrous material.

8. The development station of claim 6 further comprising:

an actuator configured to move the shunt.

9. The development station of claim 8 further comprising:

a spring for biasing the shunt to the first position; and the actuator being configured to move the shunt against the biasing of the spring.

10. An electro-photographic machine comprising:

a photoreceptive member;

a corona generating device for initially charging an image area of the photoreceptive member;

a latent image generator for selectively discharging the image area of the photoreceptive member to generate a latent image;

a development station for developing the latent image with toner from developer material supplied by the development station;

a media supply for providing media sheets;

a transfer station for transferring the developed latent image from the photoreceptive member to a media sheet received from the media supply;

a fusing station for permanently affixing the transferred latent image to the media sheet; and the development station further comprises:

a development station housing having a developer sump;

a toner supply for providing toner particles to the developer sump;

a pair of mixing augers having a volumetric space between the pair of mixing augers in which the mixing augers uniformly blend and charge toner particles into the developer material as the toner particles are provided by the toner supply;

a magnetic roller for receiving the developer material and bringing the developer material into contact with a photoreceptive member, and a magnet positioned to generate a varying magnetic field in the volumetric space between the pair of mixing augers to restrict flow of developer material being moved by the mixing augers.

11. The development station of claim 10, the magnet being movable with respect to the mixing augers to generate the varying magnetic field in the volumetric space between the mixing augers.

12. The development station of claim 11, the moveable magnet being located outside the development station housing.

13. The development station of claim 12 further comprising:

an actuator for moving the magnet bi-directionally with reference to the development station housing to alter magnetic field strength in the volumetric space between the mixing augers.

14. The development station of claim 10, the magnet being coupled to a variable power source, the variable power source being configured to vary current supplied to the magnet to alter the magnetic field generated by the magnet.

15. The development station of claim 10 further comprising:

a second magnet being located within the magnetic roller; and a moveable magnetic shunt located within the magnetic roller, the magnetic shunt in a first position reduces the magnetic field extending from the second magnet and in a second position enables the magnetic field to extend into the developer material exiting from the development station housing to restrict flow of the developer material.

16. The development station of claim 15, the shunt being comprised of ferrous material.

17. The development station of claim 15 further comprising:

an actuator configured to move the shunt.

18. The development station of claim 17 further comprising:

a spring for biasing the shunt to the first position; and the actuator being configured to move the shunt against the biasing of the spring.

* * * * *